United States Patent [19]

Tanimoto

[11] 4,452,119

[45] Jun. 5, 1984

[54] ELECTRONIC MUSICAL INSTRUMENT WITH MUSICAL INFORMATION INPUT MEANS

[75] Inventor: Akira Tanimoto, Kashihara, Japan

[73] Assignee: Sharp Kabushiki Kaisha, Osaka, Japan

[21] Appl. No.: 154,371

[22] Filed: May 29, 1980

Related U.S. Application Data

[63] Continuation of Ser. No. 881,437, Feb. 27, 1978, abandoned.

[30] Foreign Application Priority Data

Feb. 28, 1977 [JP] Japan ..... 52-22087
Dec. 26, 1977 [JP] Japan ..... 52-157815

[51] Int. Cl.[3] ..... G10F 1/00

[52] U.S. Cl. ..... 84/1.03; 84/1.01; 364/705; 368/10; 368/272; 368/274

[58] Field of Search ..... 84/1.28, 1.03, 1.01; 368/10, 75, 272–275; 364/705, 706

[56] References Cited

U.S. PATENT DOCUMENTS 3,878,750 4/1975 Kapps ..... 84/1.03
4,022,097 5/1977 Strangio ..... 84/1.03
4,089,246 5/1978 Kooker ..... 84/1.03
4,090,349 5/1978 Takase ..... 84/1.03
4,120,036 10/1978 Maeda et al. ..... 364/705
4,140,039 2/1979 Faulkner ..... 84/1.03
4,202,235 5/1980 Namiki et al. ..... 84/1.01

*Primary Examiner*—J. V. Truhe
*Assistant Examiner*—Forester W. Isen
*Attorney, Agent, or Firm*—Birch, Stewart, Kolasch & Birch

[57] ABSTRACT

Disclosed is an electronic musical instrument with musical information input keys for producing musical information. A plurality of keys are provided for generating musical information of musical notes to introduce musical tones and pitches of the musical notes into the electronic musical instrument. A memory is included within the electronic musical instrument for sequentially memorizing the musical information. A musical generator is provided for sequentially reading out the stored musical information and providing an audio music in response to the stored musical information. The electronic musical instrument may function as an attendant feature of a conventional electronic calculator and/or an electronic timepiece. In a combined electronic musical instrument and calculator, the audio music can be utilized for announcing alarm conditions such as error, premature actuations of keys, overflow, voltage drop in power supply, etc. The audio music can further be used to alarm when a predetermined time has just run in the combined electronic musical instrument and a timepiece.

34 Claims, 20 Drawing Figures

Fig. 5

| SW | P | X A | X B | Y A | Y B | |
|---|---|---|---|---|---|---|
| CL | 0 | 0 | 0 | | | |
| 1 | 0 | 1 | 0 | 0 | 0 | Y0 |
| 3 | 1 | 1 | 5 | | | |
| ♪/7 | 1 | ② | 0 | 1 | 5 | Y1 |
| 1 | 2 | 1 | 0 | ⓪ | 0 | Y2 |
| 6 | 3 | 1 | 10 | | | |
| ♩/ε | 3 | ④ | 0 | 1 | 10 | Y3 |
| • | 4 | ⑥ | 0 | | | |
| 1 | 4 | 1 | 0 | ⑥ | 0 | Y4 |
| 6 | 5 | 1 | 10 | | | |
| ♪/7 | 5 | ② | 0 | 1 | 10 | Y5 |
| 1 | 6 | 1 | 0 | ② | 0 | Y6 |
| 6 | 7 | 1 | 10 | | | |
| ♪/7 | 7 | ② | 0 | 1 | 10 | Y7 |
| 1 | 8 | 1 | 0 | ② | 0 | Y8 |
| 6 | 9 | 1 | 10 | | | |
| ♪/7 | 9 | ② | 0 | 1 | 10 | Y9 |
| 1 | 10 | 1 | 0 | ② | 0 | Y10 |
| 3 | 11 | 1 | 8 | | | |
| # | 11 | 1 | 9 | | | |
| ♪/7 | 11 | ② | 0 | 1 | 9 | Y11 |
| 1 | 12 | 1 | 0 | ② | 0 | Y12 |
| 6 | 13 | 1 | 10 | | | |
| ♪/7 | 13 | ② | 0 | 1 | 10 | Y13 |
| 1 | 14 | 1 | 0 | ② | 0 | Y14 |
| 7 | 15 | 1 | 12 | | | |
| ♩/ε | 15 | ④ | 0 | 1 | 12 | Y15 |
| ° | 16 | ⑥ | 0 | | | |
| 1 | 16 | 1 | 0 | ⑥ | 0 | Y16 |
| 5 | 17 | 1 | 8 | | | |
| # | 17 | 1 | 9 | | | |
| ♪/7 | 17 | ② | 0 | 1 | 9 | Y17 |
| 1 | 18 | 1 | 0 | ② | 0 | Y18 |
| 3 | 19 | 1 | 5 | | | |
| ♪/ε | 19 | ④ | 0 | 1 | 5 | Y19 |
| ♪/7 | 20 | ② | 13 | ④ | 0 | Y20 |

| SW | P | X A | X B | Y A | Y B | |
|---|---|---|---|---|---|---|
| 1 | 21 | 1 | 0 | ② | 13 | Y21 |
| 3 | 22 | 1 | 5 | | | |
| ♪/7 | 22 | ② | 0 | 1 | 5 | Y22 |
| ⋮ | | | | | | |
| 0 | | 0 | 0 | ② | 0 | |
| 7 | | 0 | 10 | | | |
| d/n | | ⑧ | 0 | 0 | 10 | |
| • | | ⑫ | 0 | | | |
| ♪/7 | | ② | 13 | ⑫ | 0 | |
| 11 | | E(15) | E(15) | ② | 1 | |
| | | | | E(15) | E(15) | |

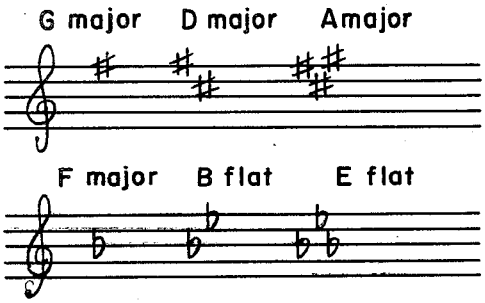
Fig. 9
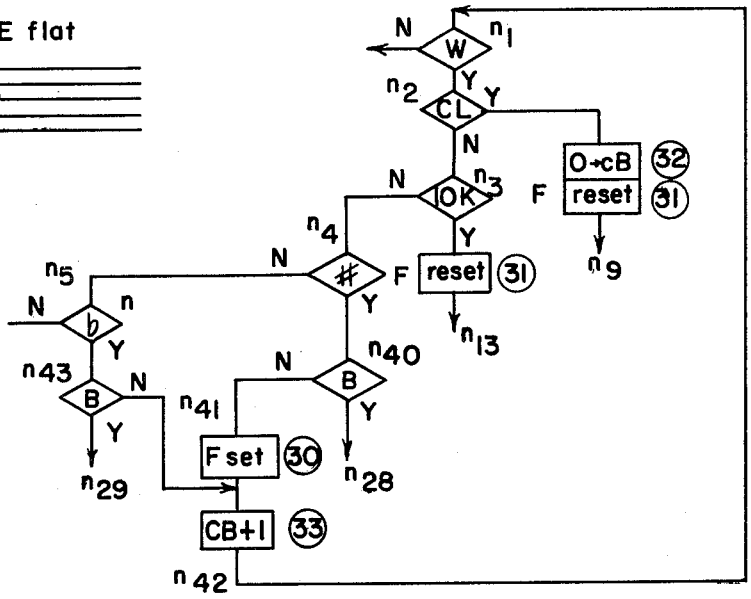
Fig. 10
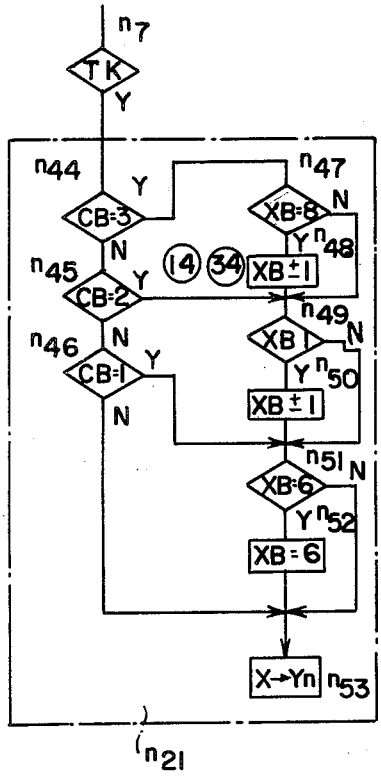
Fig. 11
Fig. 12
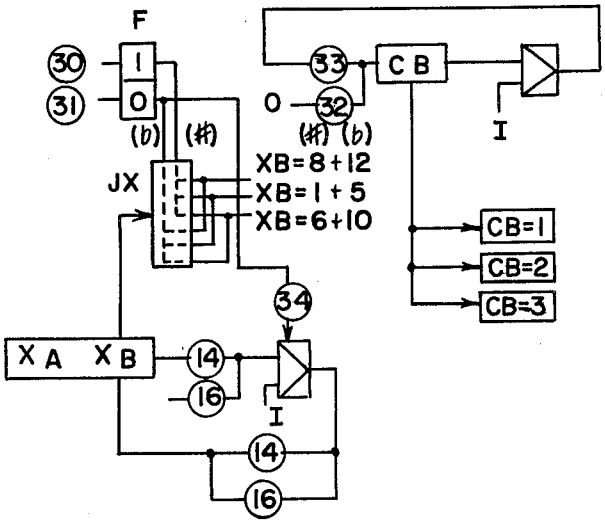

Fig. 13
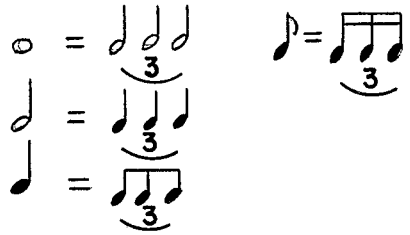
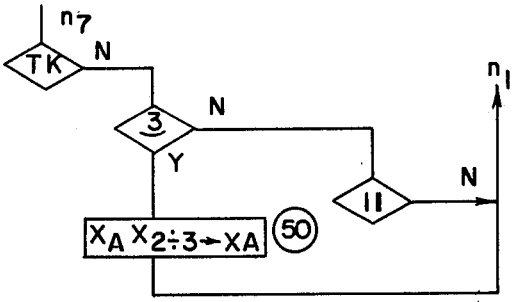
Fig. 14
Fig. 15
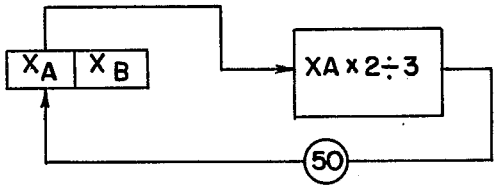
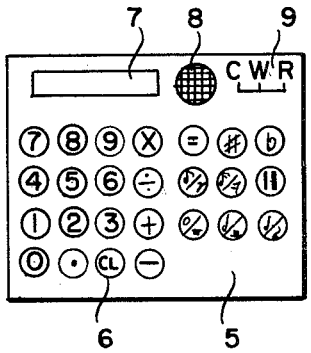
Fig. 16

ELECTRONIC MUSICAL INSTRUMENT WITH MUSICAL INFORMATION INPUT MEANS

This application is a continuation of copending application Ser. No. 881,437, filed on Feb. 27, 1978, now abandoned.

BACKGROUND OF THE INVENTION

The present invention relates to an electronic musical instrument and, more particularly, to an electronic musical instrument with musical information input means for introduction of a voluntary music program.

Recently, some electronic musical instruments have been proposed. See, for example, U.S. Pat. No. 4,059,039 by Carlson, entitled "ELECTRICAL MUSICAL INSTRUMENT WITH CHORD GENERATION", issued on Nov. 22, 1977 and assigned to Warwick Electronics Inc.

However, a musical information input key other than a chord selector is not provided in the above U.S. Pat. No. 4,059,039. Therefore, it has been strongly desired that the musical information input key be included within the electronic musical instrument for producing musical information for a voluntary music program.

OBJECTS AND SUMMARY OF THE INVENTION

With the foregoing in mind, it is a primary object of the present invention to provide a novel musical instrument with pitch input and length input means.

Another object of the present invention is to provide a novel electronic calculator which produces a voluntary music in accordance with musical information input means for introducing pitch information and length information of a voluntary music program thereinto.

Still another object of the present invention is to provide a novel electronic timepiece which generates a voluntary music program stored by musical information input means for producing pitch information and length information of a voluntary music program therein.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a plurality of keys are provided within an electronic musical instrument for introducing musical information such as musical tones and pitches of a voluntary music program into the electronic musical instrument.

A memory is included within the electronic musical instrument for sequentially memorizing the produced musical information. A musical generator is connected to the memory to provide an audio music program by sequentially reading out the stored musical information.

An electronic circuit for functioning as the well-known electronic calculator may be included within a combined electronic musical instrument and calculator in another preferable form of the present invention.

The above musical input/generator performance is utilized for indicating alarm conditions such as error, premature actuations of keys, overflow, reduced voltage in a power source, etc. The electronic circuit for the electronic calculator manipulates numeral information introduced by the actuation of any digit key in responsive to commands directed by a command key. The detail of the electronic calculator is disclosed in U.S. Pat. No. 3,829,957 entitled "DIGIT MASK LOGIC COMBINED WITH SEQUENTIALLY ADDRESSED-MEMORY IN ELECTRONIC CALCULATOR CHIP", issued on July 1, 1975 and assigned to Texas Instruments Inc., etc.

In a still another embodiment of the present invention, another electronic circuit for functioning as the well-known electronic timepiece may be incorporated within a combined electronic musical instrument and timepiece with or without the electronic calculator in another preferable form of the present invention. The above musical input/generator performance is utilized for alarming lapse of a predetermined time prestored in an electronic timepiece mode of the combined electronic musical instrument and timepiece.

BRIEF DESCRIPTION OF THE DRAWINGS

Other objects and novel features of the present invention are set forth in the appended claims and the present invention as to its organization and its mode of operation will best be understood from a consideration of the following detailed description of the preferred embodiment taken in connection with the accompanying drawings, wherein:

FIG. 5 is a control program to memorize the music shown in FIG. 4;

FIG. 9 is a diagram showing major keys used for the musical instrument;

FIGS. 10 and 11 are other flow charts effected in the embodiment of the present invention;

FIG. 12 is another block diagram of the electronic circuit of the electronic musical instrument shown in FIG. 1;

FIG. 13 is a relation diagram showing a triplet employed in the present invention;

FIG. 14 is still another flow chart effected in the embodiment of the present invention;

FIG. 15 is still another block diagram of the electronic circuit of the present invention;

FIG. 16 is a plan view of a combined electronic musical instrument and calculator according to the present invention;

DETAILED DESCRIPTION OF THE PREFERRED EMBODIMENTS

Figure 1:
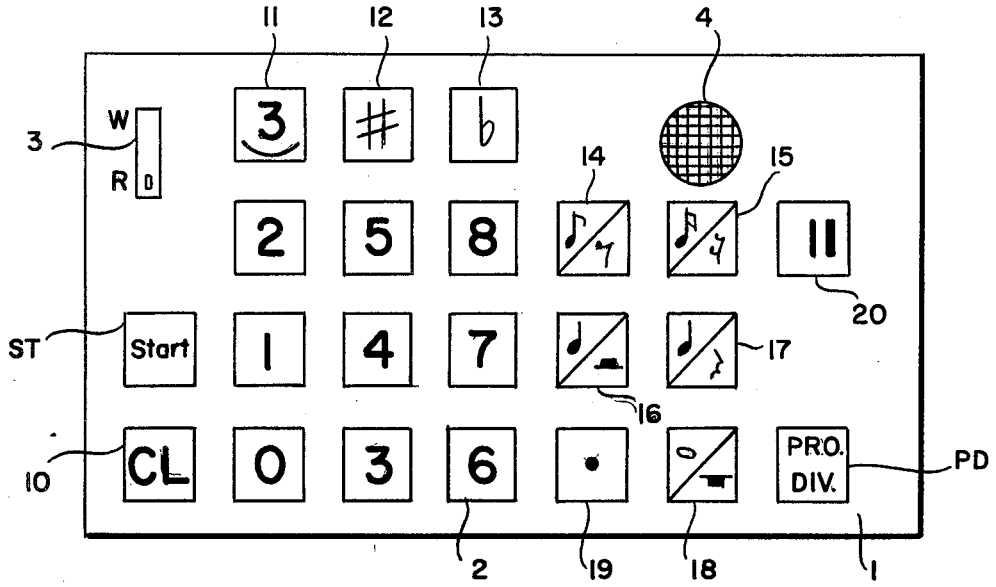
FIG. 1 is a plan view of an electronic musical instrument according to present invention.

FIG. 1 shows an electronic musical instrument 1 of the present invention, wherein there are provided a plurality of numeral keys 2, selection keys 10 through 20, a mode selection key 3, and a speaker 4.

A plurality of the keys 2, and 10 through 20 are provided for introducing a voluntary musical program into the electronic musical instrument 1.

Figure 2:
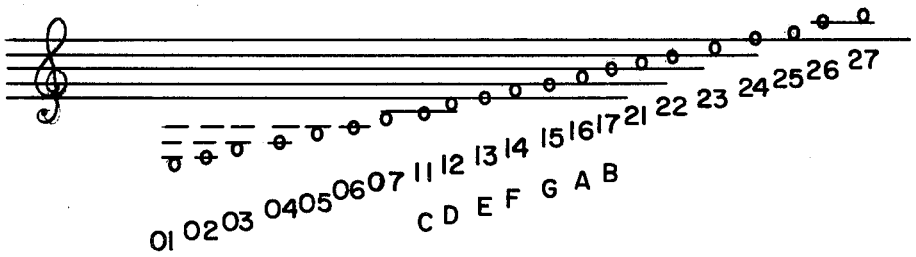
FIGS. 2 and 3 are octave diagrams employed in the musical instrument shown in FIG. 1.
Figure 3:
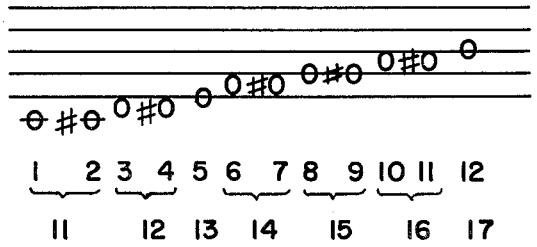

The numeral keys 2 are activated for defining pitches of notes included within a voluntary musical program. A sharp key 12 and a flat key 13 are also operated for introducing the pitches of the notes of the musical program. FIGS. 2 and 3 illustrate octave diagrams programmed by the numeral keys 2, the sharp key 12, and the flat key 13, respectively. An octave of the note is selected by a higher rank unit within numeral information entered by the actuation of the numeral keys 2 as shown in FIG. 2. The pitch in the selected octave is determined by a lower rank unit within the numeral information defined by the actuation of the numeral keys 2. The sharp key 12 functions so as to sharp the introduced musical information and the flat key 13 is operated to flat the introduced musical information. The pitches are twelve in one octave as apparently shown in FIG. 3. This requires the sharp key 12 and the flat key 13.

Duration keys 14, 15, 16, 17 and 18 are actuated to define duration of the selected note. Each of the duration keys 14 through 18 includes rest and note which are judged whether or not the keys 2 and/or the sharp and flat keys 12 and 13 are activated to define the pitch of the musical information. An additional duration key 19 is provided for adding half duration to the predetermined note as shown in a dotted half note. A clear key 10 is operated to allow storing of the introduced musical information to initiate in a program writing mode W selected by the mode selection key 3 and to allow generating of the introduced musical information to be available in a program reading out mode R selected by the mode selection key 3. A program termination key 20 is operated to denote the termination of the predetermined musical program.

Now, a control program for introducing a musical program of FIG. 4 into the electronic musical instrument 1 are described hereinbelow, the control program being shown in FIG. 5.

In FIG. 5, SW is referred to symbols of the actuated numeral keys 2 and the selection keys 10 through 20, P is referred to an address counter, X is a register which comprises two RS flip flops A and B, and Y is a program memory. The musical programs marked with a bracket in FIG. 5 correspond in order to respective musical notes included within the musical program shown in FIG. 4. A musical program stored in accordance with the following control processes is read out through the actuation of the clear key 10 and automatically produces the music program by means of the speaker 4 in the read out mode R after the musical program is stored in accordance with the control processes. The control process shown in FIG. 5 is explained with reference to flow charts illustrated in FIGS. 6 through 8.

Figure 6:
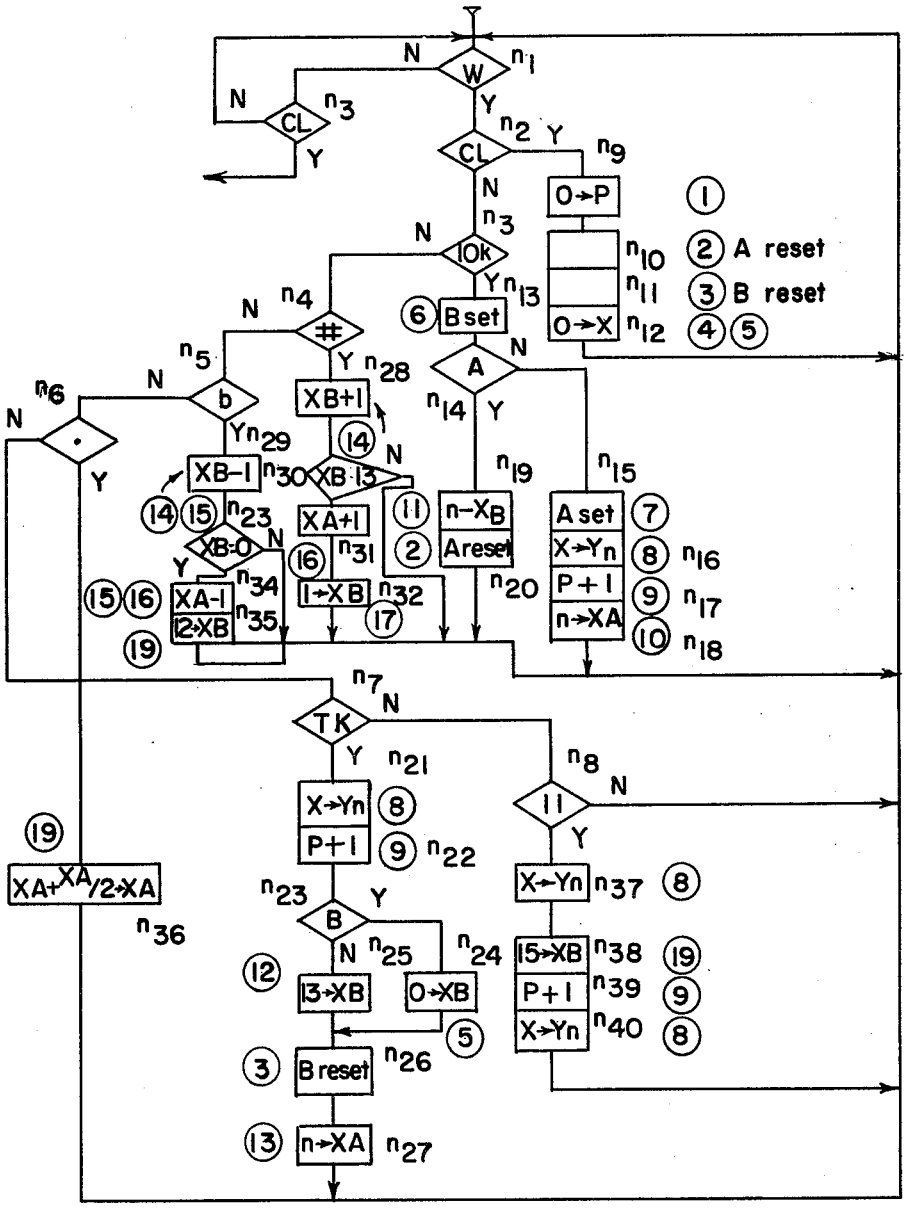
FIGS. 6 and 7 are flow charts for introducing the music of FIG. 4 to the musical instrument shown in FIG. 1.

Writing the musical program:

Initially, the mode selection key 3 is placed in the writing program mode W. A judge circuit JW is provided within an electronic circuit of the musical instrument 1 for judging whether the writing program mode W is established or not. As shown in FIG. 6, when the writing program mode W is effected, a program step $n_1$ is advanced to the program step $n_2$. The program steps $n_2$ through $n_8$ are conducted for detecting which key among the clear key 10, the numeral keys 2, the sharp key 12, the flat key 13, the additional duration key 19, and the duration keys 14 through 18 is actuated as recited hereinbelow according to FIG. 6.

The program step $n_9$ is carried out in response to the actuation of the clear key 10 and, thereafter, the address counter P included within the program memory Y is reset, namely, zero is introduced into the address counter P to direct a first step. The two RS flip flops A and B are reset before the program step $n_{12}$ is conducted. The register X comprising, for example, ten bits includes two of five bits registers XA and XB. In the program step $n_{12}$, micro orders (4) and (5) are generated to introduce zeros into the registers XA and XB, namely, to reset the registers XA and AB.

Figure 4:
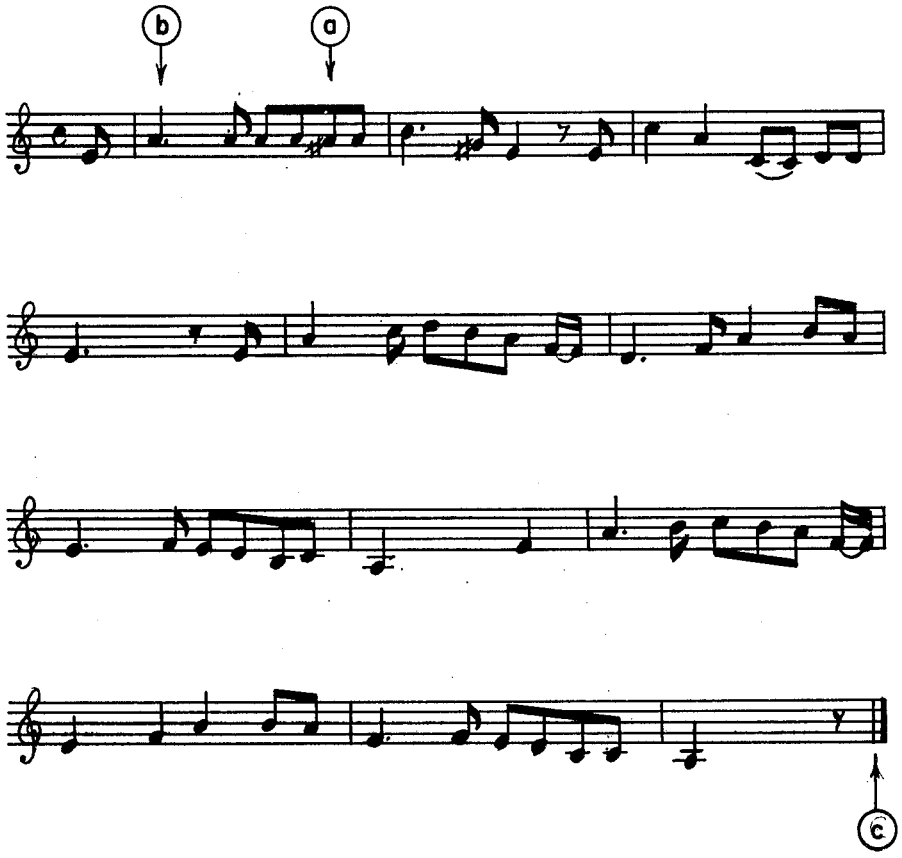
FIG. 4 is a melody of a music stored in the musical instrument shown in FIG. 1.

Under these circumstances, the numeral key "1" is firstly activated for programing a first note of the musical program shown in FIG. 4, the numeral key "1" selecting a second octave. A detector is provided for judging that anyone of the numeral keys 2 is actuated, although such detector is not shown. The program step $n_3$ proceeds to the program step $n_{13}$ as the program step $n_{13}$ is relevant to the actuation of the numeral keys 2. The flip flop B is set to memorize the actuation of someone of the numeral keys 2 before the program step $n_{14}$ is conducted.

The program step $n_{14}$ is required to determine whether the actuation of the numeral key 2 is first or second to distinguish whether the actuation is relevant to selecting one octave or a predetermined pitch within the octave. When the actuation of the numeral key 2 is first, the next program $n_{15}$ is conducted since the RS flip flop A is reset in the program step $n_{10}$ to thereby introduce zero information therein. The RS flip flop A is set to memorize the first actuation of the numeral key 2. The next program set $n_{16}$ is conducted to memorize the contents of the register X in the program memory Y which may be a nonvolatile memory.

Since the address counter P is reset in the program step $n_9$, the contents of the register X is memorized in a first step of the program memory Y. A respective suppression signal is generated from a key unit KU and is memorized in input buffer register n after encoded in an encoder $EC_1$ without being received in the register X. The first step of the program memory Y is irrelevant to the register X because the register X is reset in the program step $n_{12}$. In the program step $n_{17}$, the address counter P proceeds at count "1" by an adder $AD_1$ in the second step. The register XA memorizes codes corresponding to the numeral key "1" in the input buffer register n in the program step $n_{18}$. Thereafter, the program step $n_1$ is conducted.

When a second numeral key "3" is further actuated to define the pitch of the musical information in the selected octave, the program step $n_3$ proceeds to the program step $n_{14}$ to further effect the program step $n_{19}$ because of the set of the RS flip flop A in the program step $n_{15}$. That is, information of the second numeral key "3" stored in the input buffer register n is introduced into the register XB. The register XA has stored the information of the first numeral key "1".

The step $n_{20}$ proceeds to the step $n_1$ after the RS flip flop A is reset in the step $n_{20}$. A second encoder $EC_2$ is provided for storing the information of the second numeral key, the second encoder $EC_2$ storing the numeral "1" through "12" as shown in FIG. 3 even when the respective note is set by the actuation of the numeral keys 2 as shown in FIG. 2. That is, the contents of the input buffer register n are converted by the second encoder $EC_2$ as summarized in the following Table 1.

TABLE 1

| suppressed numeral key | codes entered into the input buffer register n (outputs of the first encoder $EC_1$) | codes entered into the register XB (outputs of the second encoder $EC_2$) |
|---|---|---|
| 1 (do) | 0001 | 00001 |
| 2 (re) | 0010 | 00011 |
| 3 (mi) | 0011 | 00101 |
| 4 (fa) | 0100 | 00110 |
| 5 (sol) | 0101 | 01000 |
| 6 (la) | 0110 | 01010 |
| 7 (ti) | 0111 | 01100 |

The codes entered into the register XB are used to select a musical source as described hereinbelow. These steps allow the register X to store the musical information which determines the pitch of the respective note.

The duration key 14 is further actuated to thereby advance the step $n_7$ to $n_{21}$. A second step (substantially a first step) of the program memory Y stores the information of the pitch because of the address counter P=1 owing to $X \rightarrow Y_n$. In the step $n_{22}$, the address counter P is counted up to become P=2. The actuation of the duration key 14 is determined to provide note information other than rest information since the actuation of the duration key 14 is occurred immediately after the actuation of a predetermined numeral key. This judgement is achieved through setting of the RS flip flop B in the step $n_{13}$.

The step $n_{23} \rightarrow n_{24}$ is effected because of B=1 to input codes of 0, namely, "00000" into the register XB. If B=0, codes of 13, namely, "01101" are entered into the register XB in the step $n_{25}$ as recited hereinbelow. The steps $n_{24}$ and $n_{25}$ are required to determine whether the actuation of the duration key 14 is directed to provide the note information or to provide the rest information through the introduction of the respective code into the register XB. The codes entered into the register XB comprising "00000" and "01101" are not doubled with the codes for representing the pitches, namely, "00001" to "01100". In the program reading out mode, the duration of the note is controlled by the outputs of the codes of "00000" or "01101".

The RS flip flop B is reset in the step $n_{26}$ after effecting the steps $n_{24}$ and $n_{25}$. A transmittance of $n \rightarrow XA$ is effected in the step $n_{27}$ to introduce the codes responsive to actuation of the duration key 14 into the register XA through a third encoder $EC_3$. The duration of a sixteenth note is defined to be "1" for comparison with the remaining notes as follows.

| In FIG. 1 | duration ratio | codes |
|---|---|---|
| the duration key 15 | 1 | 00001 |
| the duration key 14 | 2 | 00010 |
| the duration key 17 | 4 | 00100 |
| the duration key 16 | 8 | 01000 |
| the duration key 18 | 16 | 10000 |

The durations of the respective duration keys 14 through 18 are stored in the register XA after conversion to the duration rotios 1, 2, 4, 8 and 16.

When the actuation of the duration key 14 terminates, the register XA stores code information to decide the pitches of notes and the register XB stores code information to determine whether the note information or the rest information, namely, the codes of "00000" or "01101".

Further key actuations similar to the above key actuations are completed to introduce a second note of the musical program shown in FIG. 4.

The steps $n_3 \rightarrow n_{13} \rightarrow n_{14} \rightarrow n_{15} \rightarrow n_{16}$ are effected in response to a first numeral key "1". The transmittance of $X \rightarrow Y_n$ at the step $n_{16}$ is carried out to store information relevant to the duration of the first note into a third step of the program memory Y. The address counter P is counted up to make P=3 in the step $n_{17}$ and octave information of the second note is introduced into the register XA, at the step $n_{18}$. The steps $n_3 \rightarrow n_{13} \rightarrow n_{14} \rightarrow n_{19}$ are effected in response to the actuation of a next numeral key "6" to enter information of the pitch in the selected octave into the register XB. The actuation of the duration key 17 causes $n_7 \rightarrow n_{21}$ to store the information of the pitch of the second note in a fourth step of the program memory Y. These procedures are subsequently achieved in accordance with the control program shown in FIG. 5.

When notation of the sharp or flat exists as shown a position (a) in the music of FIG. 4, the sharp key 12 is actuated after the first and second numeral keys are operated to introduce the respective pitch information of the note into the registers XA and XB. The step $n_4$ proceeds to the step $n_{28}$ in response to the suppression of the sharp key 12 to make XB+1 which corresponds to sharping a tone, because the code information stored in the register XB comprises a half tone. By the flat key 13, XB−1 is achieved in the step $n_{29}$ to flat a tone. A micro order (15) functions so as to place an adder/substractor $AD_2$ to a subtractor.

The steps $n_{30}$ and $n_{31}$ are required to make the control program in order when the octave changes in accordance with sharping or flatting. Judgement according to XB=13 is required to add "1" the contents of the register XA in changing the octave when XB+1=13 and to return the contents of the register XB to "1" in the step $n_{32}$. When XB=0, the selected octave is changed to the lower octave through flatting. This requires the step $n_{33}$ to make the above judgement and to lower the selected octave by effecting of XA−1 and the step $n_{35}$ to return the contents of the register XB to "12", if XB=0.

The actuation of the additional duration key 19 causes XA+(XA/2)→XA in the step $n_{36}$.

As the duration key has been activated before the additional duration key 19, the register XA has stored duration information of the note and the register XB has also stored information to determine whether there is the note information or the rest information. In the position (b) of the music diagram of FIG. 4, the register XA has stored information 4 by the actuation of the duration key 17. A dotted quarter of the position (b) equal "6" in its duration in accordance with the duration ratio and XA+(XA/2)→XA is required.

The program termination key 20 is operated to denote the time when the termination of a voluntary musical program and the step $n_8 \rightarrow n_{38}$ is effected. $X \rightarrow Y_n$ in the step $n_{37}$ directs to introduce the duration information of the note into the program memory Y. The step $n_{38}$ is conducted to introduced the code of "15" being a termination code. The termination code of "15" is entered into the last step because the address counter P is counted up by one in the step $n_{39}$ and $X \rightarrow Y_n$ is effected in the step $n_{40}$.

The register XA may store any program information at this instance. The control program is completed as described above.

Reading out the stored musical program: The reading out of the stored musical program is achieved on the reading out mode R of the mode selection key 3 with reference to the flow chart shown in FIG. 7.

If no clear key 10 is operated in the reading out mode R, the step $n_1 \rightarrow n_3 \rightarrow n_1$ is effected, in other words, no reading out of the stored musical program is achieved. The clear key 10 functions as a musical initiate key so that the step $n_3$ proceeds to the step $n_{41}$ in response to the actuation of the clear key 10. The address counter P is initiated when $1 \rightarrow P$ is caused in the step $n_{41}$. The step $n_{42}$ and $n_{43}$ are conducted to determine whether the register YB contains "0" or "13". In other words, these steps $n_{42}$ and $n_{43}$ are required to define whether the outputs of the program memory Y is concerning the pitch of the note or the duration thereof. When there is the pitch information, $n_{42} \rightarrow n_{43} \rightarrow n_{44}$ is carried out because of $1 \leqq YB \leqq 12$. The contents of the program memory Y are entered into a buffer register Z including four bits registers ZA and ZB in the step $n_{44}$. The buffer register Z can contain the information stored in the second step of the program memory Y since $P=1$ is effected. Therefore, the step $n_{42}$ is conducted again.

Figure 8:
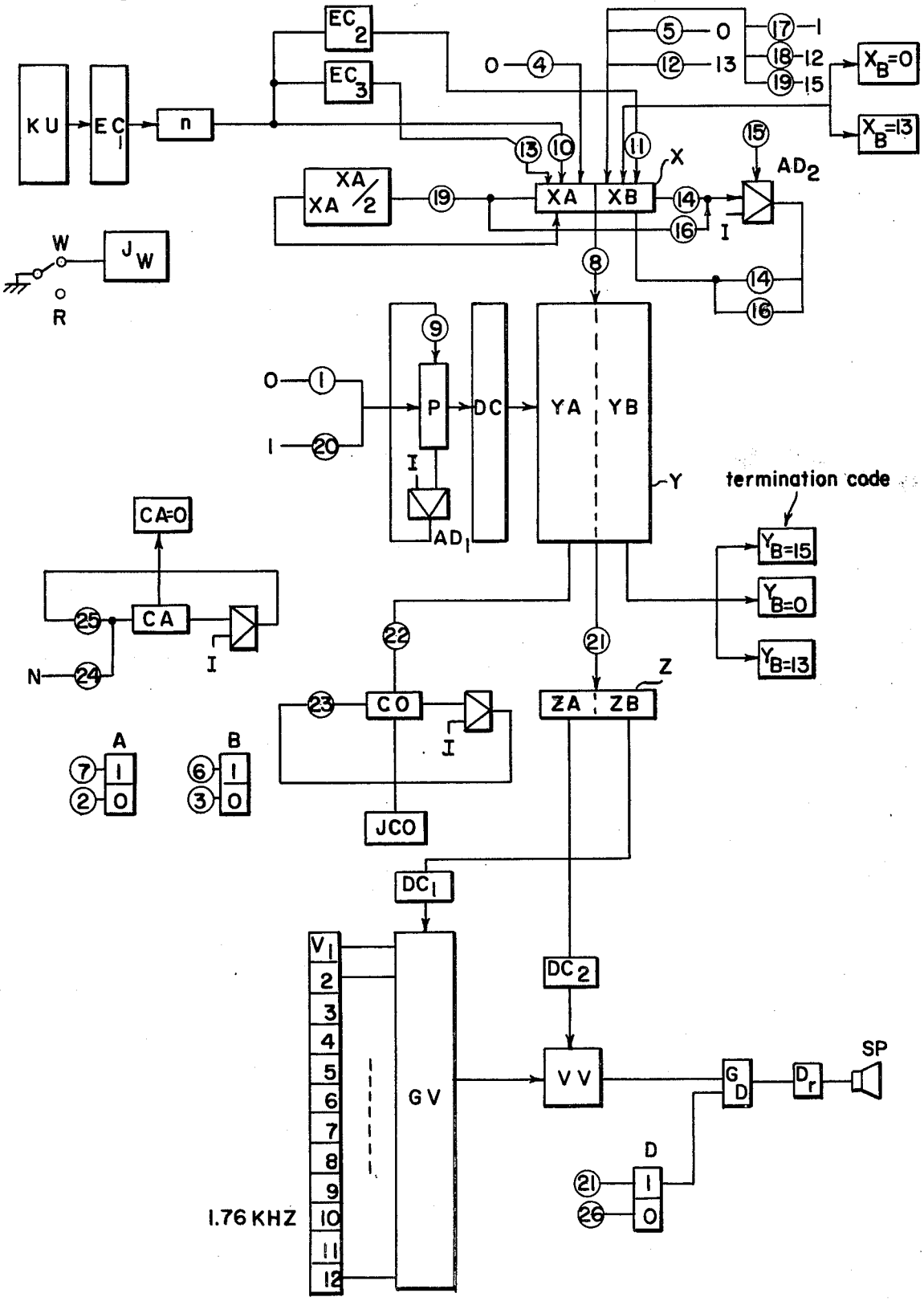
FIG. 8 is a block diagram of an electronic circuit of the electronic musical instrument shown in FIG. 1.

FIG. 8 illustrates an electronic circuit implemented within the musical instrument shown in FIG. 1. These elements included within the electronic circuit of FIG. 8 are described in accordance with the reading out of the stored musical program as recited hereinbelow.

A plurality of musical sources $V_1$ through $V_{12}$ are provided for generating the notes of the octave by a half tone thereof which are related to the octave diagram shown in FIG. 3. The musical sources $V_1$ through $V_{12}$ generate the notes within a third octave, which is the highest frequency. A gate circuit GV controls the musical sources $V_1$ through $V_{12}$, the gate circuit GV being further controlled selection signals developed from the register ZB after decoded in the decoder $DC_1$. An octave control circuit VV is provided for placing the outputs of the musical sources $V_1$ through $V_{12}$ in a selected octave through modifying the frequency of the musical sources $V_1$ through $V_{12}$ to $\frac{1}{2}$ or $\frac{1}{4}$ thereof. The note represented by "06" in the octave diagram of FIG. 2 is 880 Hz and the note denoted as "26" in the octave diagram is 1.76 kHz. Therefore, the frequency of the musical source $V_{10}$ is set to be 1.76 kHz.

When both of the numeral keys "1" and "6" are subsequently operated, $ZA=1$ and $ZB=10$ and the output of the gate circuit GV is that of the musical source $V_{10}$ at the $ZB=10$.

On the other hand, the decoder $DC_2$ is provided for generating the control signal entered into the octave control circuit VV in response to the output of the register ZA. Relation between the register ZA and the decoder $DC_2$ is defined as follows.

| register ZA | |
|---|---|
| 0 | the frequency of the output of the octave control circuit VV is one fourth of the input thereof |
| 1 | the frequency of the output of the octave control circuit VV is one half of the input thereof |
| | the frequency of the output of the octave control circuit VV is equivalent to the input thereof |

Therefore, when both of the numeral keys "1" and "6" are actuated, the output of the octave control circuit VV is $\frac{1}{2} \times 1.76$ kHz $=880$ Hz because the input thereof is 1.76 kHz. If the numeral keys "0" and "6" are both operated, the output of the octave control circuit VV is $\frac{1}{4} \times 1.76$ kHz $=440$ kHz because of 1.76 kHz of the input thereof.

As described above, the generated musical source is introduced into a gate $G_D$ and is further transmitted to a speaker SP through a driver Dr if a flip flop D has been set to thereby provide a predetermined musical tone. The musical tone is not generated even if $Y \rightarrow Z$ is effected in the step $n_{44}$. The address counter P is counted up in the step $n_{45}$ and, thereafter, the step $n_{42}$ is conducted again. The next step is carried out to determine the duration of the step $n_{42}$, namely, $YB=0$ or $YB=13$ is effected. $YB=0$ allows the RS flip flop D set in the step $n_{46}$ to generate a selected tone and the step $n_{47}$ is conducted. $YB=13$ makes the RS flip flop D remain reset because the rest information and the step $n_{47}$ are conducted. The step $n_{46} \rightarrow n_{47}$ is carried out to introduce the contents of the register YA into a counter CO before the step $n_{48}$ is carried out. If the counter CO contains no zero, $CO-1$ is effected in the step $n_{49}$ before the step $n_{50}$ is conducted.

The steps $n_{50}$, $n_{51}$, and $n_{52}$ are conducted to determine an unit time of the counter CO, that is, an initial value N is introduced into a counter CA at the step $n_{50}$, and judgement of $CA=0$ in the step $n_{51}$. The performance of $CA-1$ is effected in the step $n_{52}$ until $CA=0$ and the step $n_{48}$ is conducted again with $CA=0$.

As apparent from the above description, the contents of the counter CO are directly proportional to the duration of the note, the contents being derived from the register YA. The contents of the counter CO become immediately zero with rapid driving. The contents of the counter CA should be appropriated to a predetermined musical note and, therefore, time periods when the counter CA counts at N times are selected to be the length of the sixteenth note. As length of the note varies in accordance with the selected musical note, it is more preferable that the initial value N entered into the counter CA is selected by a switching means (not shown).

When $CO=0$, the RS flip flop D is reset in the step $n_{53}$. The speaker SP provides the selected musical tone since the flip flop D has been set. If $YB=13$, the rest is caused as counting is achieved with keeping reset the RS flip flop D.

The address counter P is counted up in the step $n_{54}$ before the step $n_{55}$ is carried out $YB=15$ is effected for determining the termination or not. If the termination code "15" is contained within the register YB, the step $n_1$ is conducted again. If not, the step $n_{42}$ is conducted again. The output of the program memory Y proceeds to the next step thereof as $P+1$ is achieved in the step $n_{54}$. The stored musical program is developed from the speaker SP by the above performance until the termination code is shown.

Now the variation of the note in any key other than the key of C major of the above description will be described.

The sharp key 12 and the flat key 13 are further utilized for defining the key of the selected music. A G. major is effected by once actuation of the sharp key 12 after the activation of the clear key 10. An A major is achieved by triple actuations of the sharp key 12 after the actuation of the clear key 10. An F major is established by one suppression of the flat key 13 and an E flat is effected by triple actuations of the flat key 13 after the actuation of the clear key 10, respectively. The variations of the keys are described in detail with reference to the flow chart shown in FIG. 10.

Each of the sharp key 12 and the flat key 13 is operated for defining the musical key before any one of the numeral keys 2 is actuated in the writing program mode W. Each of the sharp key 12 and the flat key 13 is otherwise activated for introducing musical tones after the actuation of the numeral keys 2. When the sharp key 12 is activated under the condition of B=0 to thereby effect $n_{40} \rightarrow n_{41}$ so as to allow a flip flop F to set and to add "1" to a counter CB, since the RS flip flop B is always set in response to the numeral key 2. CB+1 is achieved before the flip flop F is set if the flat key 13 is actuated. The counter CB stores actuation times of the sharp key 12 and the flat key 13. The flip flop F also stores recognition between the sharp key 12 and the flat key 13.

The step $n_{44}$ is conducted through the actuation of the duration keys 14 through 19 which are operated for introducing the musical tone. The steps $n_{44}$, $n_{45}$ and $n_{46}$ are conducted to judge the contents of the counter CB.

When either the A major or the E flat major key is used, the step $n_{47}$ is conducted under the condition of CB=3 and XB+1 is effected under one among XB=8 XB=1, and XB=6. XB+1 occurs to sharp since the register XB contains the pitch information immediately after the actuation of the duration keys 14 through 19. $X \rightarrow Y_n$ is effected in the step $n_{21}$ directly after the activation of the duration keys 14 through 19 allows all the notes marked with the notation of sharp in the diagram shown in FIG. 9 to sharp.

The micro order 34 is utilized to define XB−1 in the reset of the flip-flop F and to determine XB+1 in the set of the same. XB+1 occurs in the set of the flip flop F since the flip flop F becomes set in response to the actuation of the sharp key 12. When the flat key 13 is operated, XB−1 is achieved to flat a tone as F=0.

When a D major key is achieved by twice actuating the sharp key 12, $n_{45} \rightarrow n_{49}$ is effected since CB=2 to thereby neglect processing of XB=6 in order to sharp notation added in the A major key.

A judge circuit JX shown in FIG. 12 is provided for judging the steps $n_{47}$, $n_{49}$ and $n_{51}$. Conditions of the flip flop F control judgement achieved in the judge circuit JX that is, when F=0, the judgement is applied to whether XB=12, XB=5, and XB=1 or not. The judgement is required in the F major, a B flat, and the E flat.

The variations of the tones are completed through changing the steps $n_{21}$ and $n_{37}$ of the flow chart of FIG. 6 to the flow chart shown in FIG. 11 as described above. The input of a triplet has not been described.

The input of the triplet shown in FIG. 13 requires the actuation of a triplet key 11 of FIG. 1. The input of the triplet consisting of three quarter notes is enabled in the order of the actuations of the duration key 17, the triplet key 11, the duration key 17, the triplet key 11, the duration key 17, and the triplet key 11. The diagrams shown in FIGS. 14 and 15 represent the control processes for one triplet. The actuation of the triplet key 11 makes the pitch information relative to the duration key 17 stored in the register XA twice, namely, the pitch information of a half note. Thereafter, the register XA receives one third of the pitch information of the half tone. By these procedures, the length of the quarter included within the triplet becomes one third of the duration of the half note. $XA \times 2 \div 3 \rightarrow XA$ is effected in association with the actuation of the triplet key 11.

Figure 17:
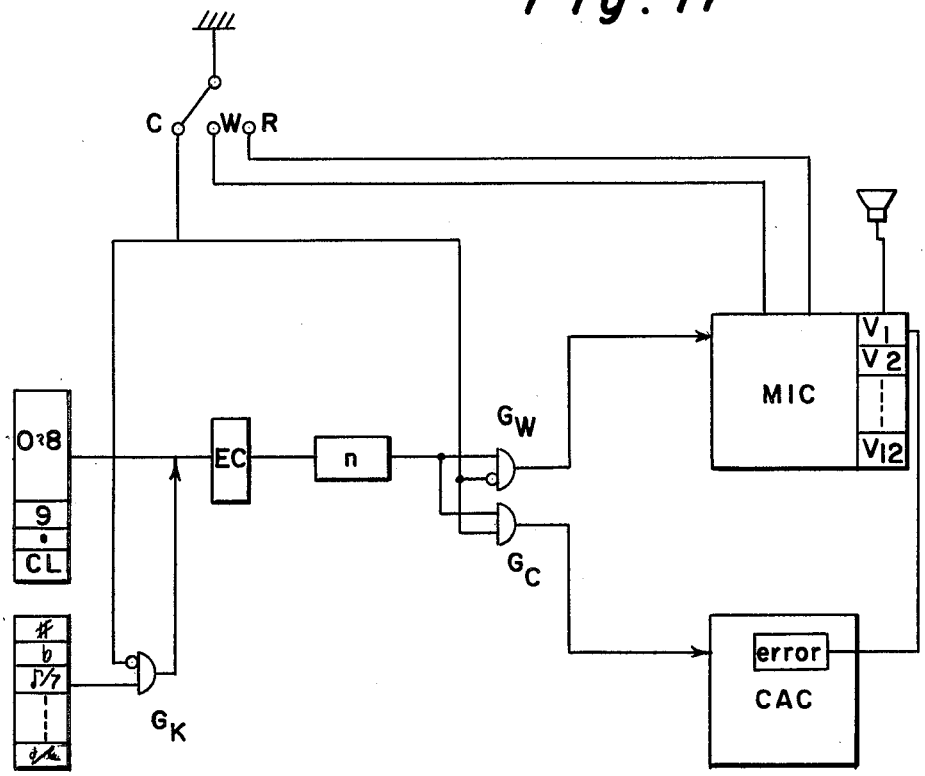
FIG. 17 is a block diagram of an electronic circuit of the combined electronic musical instrument and calculator shown in FIG. 17.

An attention is now directed to another embodiment of the present invention, wherein there is provided a combined electronic musical instrument and calculator as shown in FIGS. 16 and 17.

FIG. 16 illustrates the combined electronic musical instrument and calculator 5 comprising a plurality of keys 6, a display 7, a speaker 8, and a mode selection key 9. The mode selection key 9 is provided for selecting one of three modes consisting of the program writing mode W, the program reading mode R, and a calculation mode C. A clear key 10A is operated for sweeping out information stored in a calculation circuit in the calculation mode C. An additional duration key 19A similar to the additional duration key 19 shown in FIG. 1 functions as a decimal key in the calculation mode C. Ten numeral keys also function to introduce respective numeral information into the calculation circuit for calculation.

An electronic circuit implemented within the combined electronic musical instrument and calculator is shown in FIG. 17. A calculator CAC receivers the information derived from the numeral keys, the decimal key 19A, and the clear key 10A through a gate circuit $G_C$. Meanwhile, another gate circuit $G_K$ restricts the information irrelevant to the calculator derived from the remaining keys concerning the musical instrument only. Like keys to FIG. 1 are designated by like numerals with the suffix A.

A musical controller MIC receives the information generated from the actuation of all the keys through a gate circuit $G_W$ in the program writing mode W and the program reading mode R. The musical sources $V_1$ through $V_{12}$ included within the musical controller MIC can be applied to indicate the actuation of someone of the keys 6, calculation error conditions, and lowering of a power source in the calculation mode C. The detailed description of the calculator CAC is omitted because it is the well-known matter for those persons skilled in the art.

In another application of the combined electronic musical instrument and calculator 5, a combination of the calculator and the above musical writing/reading operation is employed within the combined electronic musical instrument and calculator 5. More particularly, the musical writing/reading operation is utilized for indicating an alarm condition in the calculator mode C. For this end, it is preferable that the program memory Y comprises a nonvolatile memory. Generation of the musical program stored in the combined electronic musical instrument and calculator 5 announces the alarm condition comprising the calculation errors, premature actuations of the keys, overflow information, voltage drop in the power source, etc.

Figure 7:
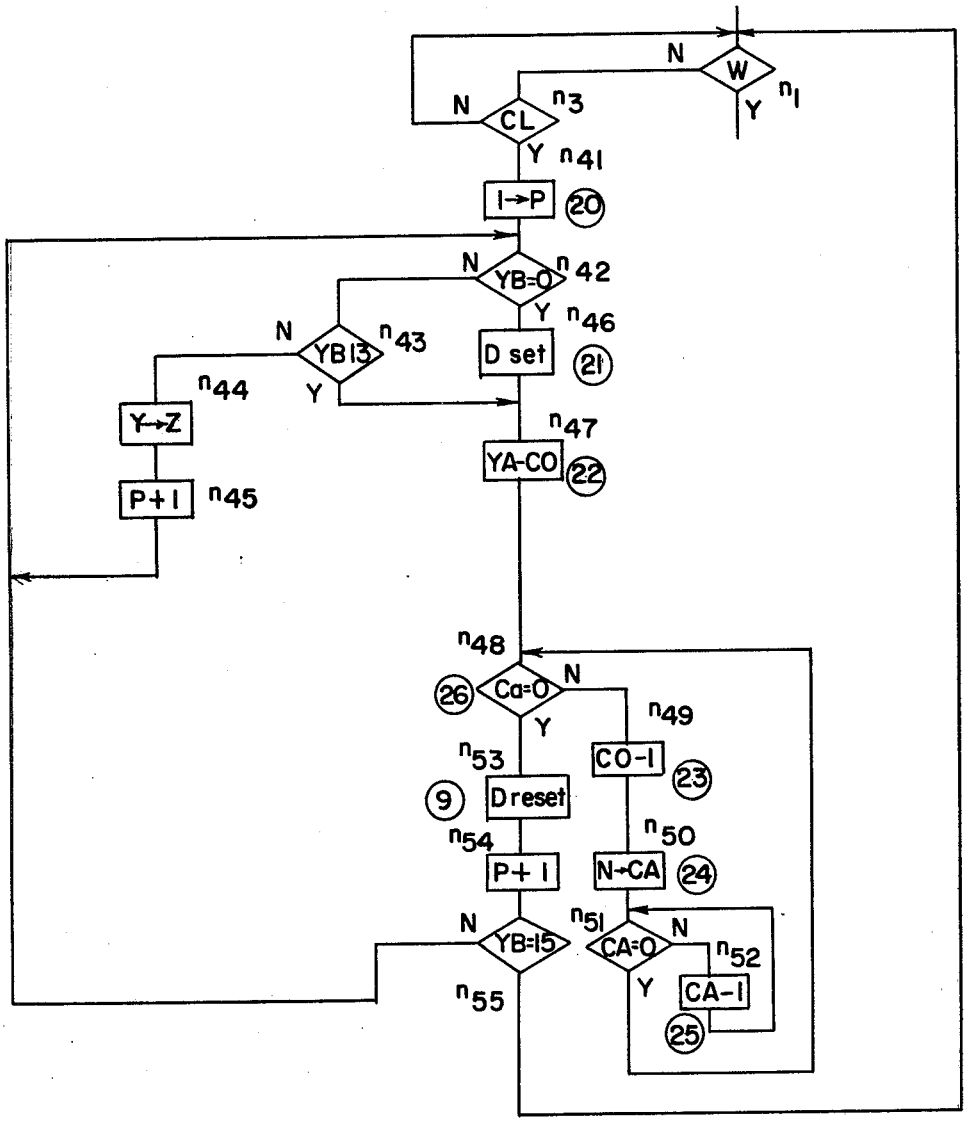

In the flow charts shown in FIGS. 6 and 7, the clear key 10 controls writing/reading of the musical program. However, it is more preferable that the musical program is stored in a divided condition for the utilization thereof to store a plurality of the musical programs in one program memory Y. Therefore, a program divide key PD is provided in association with the numeral keys for directing the division of the musical program in the program memory Y. A start key ST is providing for initiating the writing/reading of the musical program.

In the writing of the musical program as shown in FIG. 6, the address counter P is initiated by the actuation of the clear key 10. However, in this application the address counter P is controlled in accordance with the contents of the numeral key immediately after the actuation of the program divide key PD as follows.

The program divide key PD and the numeral key "1": the address counter P is initiated to "0" using the steps "0" to "49" in the program memory Y.

The program divide key PD and the numeral key "2": the address counter P receives the information of numeral "50" using the steps "50" to "99" in the program memory Y.

The program divide key PD and the numeral key "3": the address counter P receives the information of numeral "100" using the steps "100" to "149".

The input of the information of the numeral "0", the numeral "50", and the numeral "100" is effected in the step $n_9$ in lieu of 0→P.

Error signals are utilized for reading out the musical program instead of the clear key 10. When calculation error conditions are announced, 1→P is effected in the step $n_{41}$ in the flow chart shown in FIG. 7 in response to the error signals. When the premature actuations of the keys are indicated, 50→P is carried out in the step $n_{41}$ in the above flow chart in response to premature actuations detection signals. When the overflow of input information is announced, 100→P is effected in the step $n_{41}$ in response to overflow detection signals.

It is further desirable that a desired initial address is selected in the step $n_{41}$ through the actuations of the program divide key and one of the numeral keys "1", "2", and "3" to store a plurality of the musical programs and produce a desirable musical program among the stored musical programs.

Figure 18:
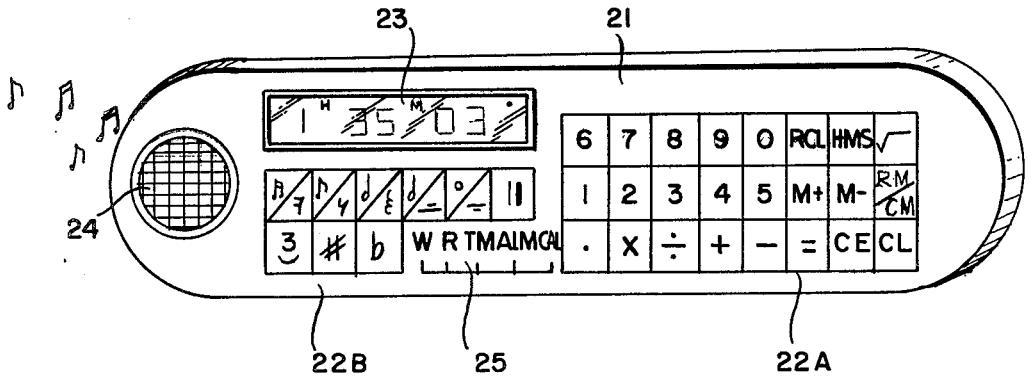
FIG. 18 is a perspective view of a combined electronic musical instrument and calculator and timepiece according to the present invention.

A further attention is directed to FIG. 18, wherein there is a combined electronic musical instrument and calculator and timepiece 21 of the present invention.

The combined electronic musical instrument and calculator and timepiece 21 comprises two key groups 22 A and 22 B, a display 23, a speaker 24, a mode selection key 25. The key group 22A includes the numeral keys 2 and the sharp key 12 and the flat key 13 shown in FIG. 1 for defining the pitches of the musical notes. The key group 22 B also includes the duration keys 14 through 19 shown in FIG. 1 for determining the length of the musical notes.

The clear key included within the key group 22 A is related to the clear key 10 shown in FIG. 1. The termination key employed within the key group 22A is also related to the termination key 20 illustrate in FIG. 1. The mode selection key 25 is provided for selecting any one of the electronic musical instrument mode, the electronic calculator, and an electronic timepiece mode.

Figure 19:
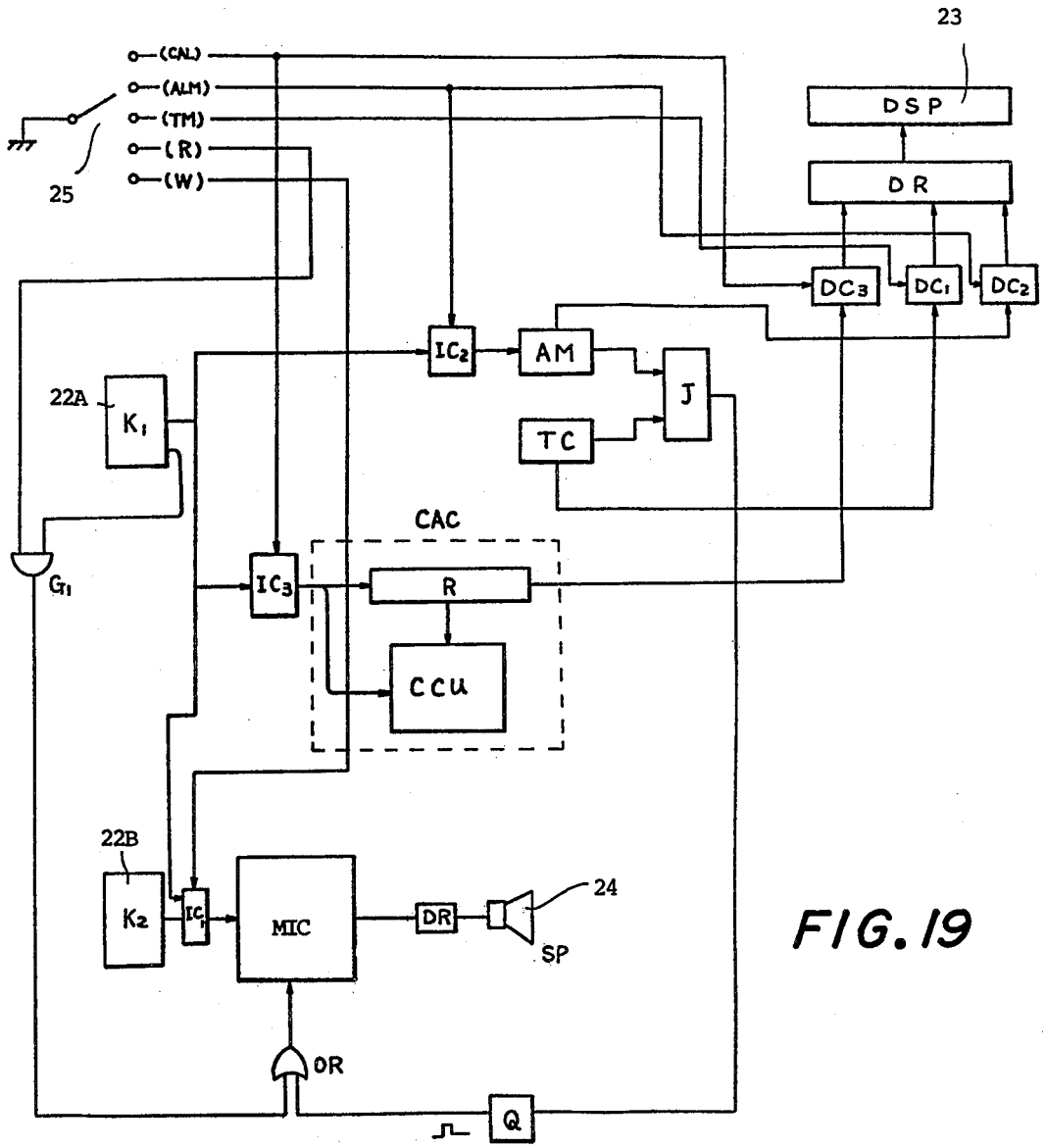
FIGS. 19 and 20 are block diagrams of an electronic circuit included within the combined electronic musical instrument and calculator and timepiece shown in FIG. 18.

FIG. 11 illustrates an electronic circuit included within the combined electronic musical instrument and calculator and timepiece 21. In FIG. 19, two key units $K_1$ and $K_2$ correspond, respectively to the key groups 22 A and 22 B.

Program writing mode

In the program writing mode W of the combined electronic musical instrument and calculator and timepiece 21, an input controller $IC_1$ enables the writing of the musical program to store a desirable musical program in the musical controller MIC in response to the activations of the key units $K_1$ and $K_2$.

Program reading mode

In the program reading mode R of the combined electronic musical instruments and calculator and timepiece 21, a gate circuit $G_1$ is conducted to make the musical controller MIC operative using the actuation of the clear key employed within the key unit $K_1$. The music controller MIC functions as described above.

A timepiece mode (TM)

Horological information is continuously derived in a time circuit TC. In the timepiece mode TM, a controller $DC_1$ is conducted to indicate the horological information in the display (DSP) 23 through a driver DR.

Alarm time memory mode (ALM)

The information derived from the key unit $K_1$ is introduced into an alarm time memory AM through the conductance of an input controller $IC_2$ in the alarm time memory mode ALM, the actuation of the key unit $K_1$ selecting the desirable alarm time. The numeral keys included within the key unit $K_1$ are activated for introducing the numerals of the alarm time and, thereafter, time information key which is indicated by the notation HMS included within the key group 22 A is operated for converting the numerals of the alarm time to time information corresponding to the numerals. The time information is stored in the alarm time memory AM.

A judgement circuit J functions to judge the coincidence between the time information stored in the time circuit TC and the alarm time memory AM and to generate the output in accordance with the coincidence. Any programmed musical program is developed in accordance with the judgement circuit J for announcing the alarm conditions. In the alarm time memory mode ALM, the time information stored in the alarm time memory AM is indicated in the display (DSP) 23 through a controller $DC_2$ and the driver DR.

Calculation mode (CAL)

The information developed from the key unit $K_1$ is entered into a register R or a calculation circuit $CC_u$ through an input controller $IC_3$ in a calculation mode CAL. The register R is provided for receiving numeral information derived from the key unit $K_1$. The calculation circuit $CC_u$ is provided for importing functional information developed from function keys included within the key unit $K_1$. Manipulation of the numeral information in accordance with the functional information is carried out in the register R and calculation circuit $CC_u$ and results of the manipulation are introduced and stored in the register R. The contents of the register R are indicated in the display (DSP) 23 through the controller $DC_3$ and the driver DR, the contents of the register R being the numeral information and the calculated results.

Announcement of the stored alarm time is always available in all the above modes and only in the alarm time memory mode can the announcement be eliminated.

When the judgement circuit J is conducted owing to the coincidence of the time information stored in the time circuit TC and the alarm time memory AM, an one-shot pulse generator Q is operated to impart the one-shot pulse to the musical controller MIC. An OR gate OR is provided for conducting one of the one-shot pulse and key information generated by the clear key included within the key unit $K_1$ into the musical controller MIC. The stored musical program is developed in response to generation of the one-shot pulse for announcing the alarm time.

Although in the flow chart shown in FIG. 7, $n_3 \rightarrow n_{41}$ is effected only in the program reading mode R, the step $n_{41}$ is unconditionally conducted in accordance with the generation of the one-shot pulse.

Figure 20:
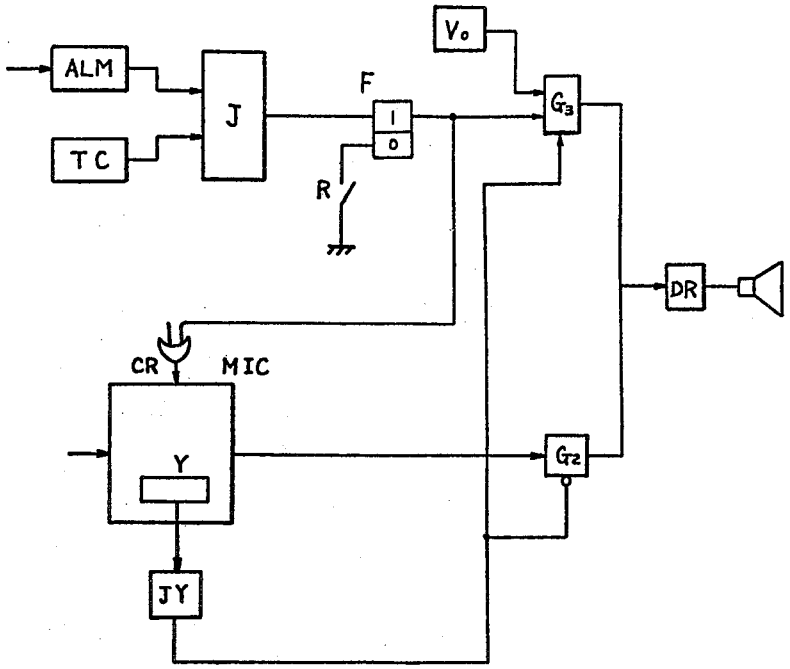

FIG. 20 shows another electronic circuit included within the combined electronic musical instrument and calculator and timepiece 21. The electronic circuit of FIG. 20 is especially directed to develop a single musical tone for announcing the alarm condition when no musical program is stored.

A judgement circuit JY is provided for determining whether the program memory Y included within the musical controller MIC stores information or not to control gate circuits $G_2$ and $G_3$. The gate circuit $G_2$ is connected when the information is stored in the program memory Y. The gate circuit $G_3$ is conducted when no information is contained in the program memory Y. A flip flop F is set by the output of the judgement circuit J to develop the stored musical program in the speaker through a gate $G_3$ from the musical controller MIC when the musical program is stored in the program memory Y. If the program memory Y does not contain any musical program, a single musical tone is generated from a musical source $V_0$ through the gate $G_3$. A reset key R is connected to the flip flop F for restricting the single musical tone.

While only certain embodiments of the present invention have been described, it will be apparent to those skilled in the art that various changes and modifications may be made therein without departing from the spirit and scope of the invention as claimed.

What is claimed is:

1. In an electronic musical instrument comprising means for generating a digital representation corresponding to each of a sequence of musical notes; electronic memory means for storing each of said digital representations; means for sequentially recovering each of said digital representations from said electronic memory means, and means for generating audio signals corresponding to the sequence of musical notes from said digital representations, the improvement comprising:

input key switch means within said digital representation generating means for selecting octave, pitch, and duration of notes and designation of rests, and including; a plurality of input key switches contained within a first actuated group, at least one of which is actuated for determining only octave information, a plurality of input key switches contained within a subsequently actuated group, at least one of which is actuated for determining only pitch information of musical notes;

each of said first actuated input key switches having indicia determinative of the octave information of the musical notes and each said subsequently actuated input key switches having indicia determinative of the pitch information of the musical notes in a selected octave; and a second plurality of input key switches at least one of said switches being subsequently actuated for determining only length information of said musical notes together with information indicative of the identity and occurrence of rest codes.

2. The electronic musical instrument of claim 1, which further includes sharp and flat input key switch means for introducing sharp and flat information to raise and lower, respectively, the pitch of said musical notes in association with said input key switches determinative of said notes.

3. The electronic musical instrument according to claim 1, which further includes mode selector means for selectively placing said instrument in musical note writing and musical note reading modes, the musical note writing mode being effected to memorize the musical note in the memory means in accordance with actuated ones of said input key switches; said input key switches including a start key; and said instrument, in said musical note reading mode being constrained to produce the stored musical note from said memory means in response to the actuating of said start key.

4. The electronic musical instrument according to claim 1, which further includes alarm means responsive to predetermined conditions in said musical instrument for generating a stored musical note for annunciating the occurrence of said predetermined conditions.

5. The electronic musical instrument according to claim 2, wherein said sharp and flat input key switch means is employed for identifying tone information over the sequence of the musical notes.

6. The electronic musical instrument according to claim 1, wherein there is further provided a triplet input key switch for changing code information to modify the length of said musical notes.

7. The electronic musical instrument according to claim 1, wherein there is further provided a music program dividing key means for dividing the digital representations into selected subsequences of musical notes.

8. The electronic musical instrument according to claim 1, wherein an electronic timepiece means is further incorporated within the electronic musical instrument for generating horological information.

9. The electronic musical instrument according to claim 8, which further includes alarm means responsive to said horological information for generating a said stored musical note for annunciating when a predetermined time has just run in said musical instrument.

10. The electronic musical instrument according to claim 9, which further includes alarm means responsive to predetermined conditions in said musical instrument for generating a stored musical note for annunciating the occurrence of said predetermined conditions.

11. The electronic musical instrument according to claim 10, wherein said alarm means is further responsive to said horological information for generating a said stored musical note for annunciating when a predetermined time has just run in said musical instrument.

12. The electronic musical instrument according to claim 8, which further includes alarm means responsive to said horological information for annunciating when a predetermined time has just run in said musical instrument.

13. The musical instrument of claim 7, wherein said music program dividing key means generates music program dividing code information to divide the digital representations of musical information into said selected subsequences of musical notes.

14. In an electronic musical instrument comprising means for generating a digital representation corresponding to each of a sequence of musical notes; electronic memory means for storing each of said digital representations; means for sequentially recovering each of said digital representations from said electronic memory means, and means for generating audio signals corresponding to the sequence of musical notes from said digital representations, the improvement comprising:

input key switch means within said digital representation generating means for selecting octave, pitch, and duration of notes, and including a plurality of input key switches contained within a first actuated group, at least one of which is actuated for determining only octave information, a plurality of input key switches contained within a subsequently actuated group, at least one of which is actuated for determining only pitch information of musical notes;

each of said first actuated input key switches having indicia determinative of the octave information of the musical notes and each of said subsequently actuated input key switches having indicia determinative of the pitch information of the musical notes in a selected octave; and a second plurality of input key switches being subsequently actuated for determining only length information of said musical notes and having indicia determinative of said length information of the said musical notes.

15. The electronic musical instrument according to claim 14, which further includes sharp and flat input key switch means for introducing sharp and flat information to raise and lower, respectively, the pitch of said musical notes in association with said input key switches determinative of said notes.

16. The electronic musical instrument according to claim 14, further comprising electronic calculator means for performing arithmetic operations implemented within the electronic musical instrument;

said electronic calculator means including function key means for selectively designating functional operating modes for said calculator means; and wherein said input key switches introduce numeral information into the electronic calculator to be processed therein in accordance with a said functional operating mode designated by said function key means.

17. The electronic musical instrument according to claim 15, wherein said sharp and flat input key switch means is employed for identifying tone information over the sequence of the musical notes.

18. The electronic musical instrument according to claim 14, wherein there is further provided a triplet input key switch for changing code information to modify the length of said musical notes.

19. The electronic musical instrument according to claim 14, wherein there is further provided a music program dividing key means for dividing the digital representations into selected subsequence of musical notes.

20. The electronic musical instrument according to claim 14, which further includes mode selector means for selectively placing said instrument in musical note writing and musical note reading modes, the musical note writing mode being effected to memorize the musical note in the memory means in accordance with actuated ones of said input key switches; said input key switches including a start key; and said instrument, in said musical note reading mode being constrained to produce the stored musical note from said memory means in response to the actuating of said start key.

21. The electronic musical instrument according to claim 14, which further includes alarm means responsive to predetermined conditions in said musical instrument for generating a stored musical note for annunciating the occurrence of said predetermined conditions.

22. The electronic musical instrument according to claim 14, wherein an electronic timepiece means is further incorporated within the electronic musical instrument for generating horological information.

23. The electronic musical instrument according to claim 22, which further includes alarm means responsive to said horological information for generating a said stored musical note for annunciating when a predetermined time has just run in said musical instrument.

24. The electronic musical instrument according to claim 14, wherein:

electronic calculator means are implemented within the electronic musical instrument;

said electronic calculator means including function key means for selectively designating functional operating modes for said calculator means; and wherein said input key switches are adapted to introduce numeral information into the electronic calculator to be processed therein in accordance with a said functional operating mode designated by said function key means; and an electronic timepiece means is further incorporated within the electronic musical instrument for generating horological information.

25. The electronic musical instrument according to claim 24, which further includes alarm means responsive to said horological information for generating a said stored musical note for annunciating when a predetermined time has just run in said musical instrument.

26. The electronic musical instrument according to claim 24, which further includes alarm means responsive to predetermined conditions in said musical instrument for generating a stored musical note for annunciating the occurrence of said predetermined conditions.

27. The electronic musical instrument according to claim 26, wherein said alarm means is further responsive to said horological information for generating a said stored musical note for annunciating when a predetermined time has just run in said musical instrument.

28. The musical instrument of claim 14, wherein the digital representation corresponding to each musical note includes information determinative of the pitch, octave, and length qualities of each musical note, one of said input key switches being actuated to enter information relating to each quality of each musical note.

29. The musical instrument of claim 19, wherein said music program dividing key means generates program dividing code information to divide the digital representations of musical information into selected subsequences of musical notes.

30. In an electronic musical instrument and calculating system comprising means for generating a digital representation corresponding to each of a sequence of musical notes; electronic memory means for storing each of said digital representations; means for sequentially recovering each of said digital representations from said electronic memory means, and means for generating audio signals corresponding to the sequence of musical notes from the said digital representations, the improvement comprising:

electronic calculator means for performing arithmetic operations including function key means for selectively designating functional operating modes for said calculator means;

input key switch means within said digital representation generating means for selecting octave, pitch, and duration of notes and designation of rests, and including a plurality of input key switches contained within a first actuated group at least one of which is actuated for determining only octave information, a plurality of input key switches contained within a subsequently actuated group, at least one of which is actuated for determining only pitch information of musical notes;

each of said first actuated input key switches having indicia determinative of the octave information of the musical notes and each of said subsequently actuated input key switches having indicia determinative of the pitch information of the musical notes in a selected octave; and a second plurality of input key switches at least one of which is subsequently actuated for determining only length information of said musical notes and having indicia determinative of said length information together with information indicative of the indentity and occurrence of rest codes, said input key switches further introducing numeral information into said electronic calculating means to be processed therein when desired in accordance with a said functional operating mode designated by said function key means.

31. In an electronic musical instrument, calculator and timepiece comprising means for generating a digital representation corresponding to each of a sequence of musical notes, electronic memory means for storing each of said digital representations, means for sequentially recovering each of said digital representations from said electronic memory means, and means for generating audio signals corresponding to the sequence of musical notes from said digital representations, the improvement comprising:

electronic calculator means for performing arithmetic operations including function key means for selectively designating functional operating modes for said calculator means;

electronic timepiece means for generating horological information;

input key switch means within said digital representation generating means for selecting octave, pitch and duration of notes and designation of rests, and including a plurality of input key switches contained within a first actuated group at least one of which is actuated for determining only octave information, a plurality of input key switches contained within a subsequently actuated group, at least one of which is actuated for determining only pitch information of musical notes;

each of said first actuated input key switch having indicia determinative of the octave information of the musical notes and each of said subsequently actuated input key switches having indicia determinative of the pitch information of the musical notes in a selected octave; and a second plurality of input key switches at least one of which is subsequently actuated for determining only length information of said musical notes and having indicia determinative of said length information together with information indicative of the identity and occurrence of rest codes;

said input key switches further introducing numeral information into said electronic calculator means to be processed therein when desired in accordance with a said functional operating mode designated by said function key means.

32. An electronic calculator and timepiece comprising:

input key switch means including a single plurality of keys for both providing numeral information and musical information;

processing means responsive to said numeral information provided by said input key switch means for calculating arithmetic operations;

means responsive to said musical information provided by said input key switch means for decoding said musical information;

memory means for storing and later recalling said decoded musical information;

means responsive to information recalled from said memory means for generating audible sounds in response thereto; and a timepiece having an alarm;

said means for generating audible sounds being actuated in response to activation of said alarm.

33. A combined electronic calculator and timepiece comprising:

means for generating horological information;

input key switch means including a single plurality of keys for providing both numeral information and musical information;

processing means responsive to said digit information provided by said input key switch means for calculating arithmetic operations;

means responsive to said musical information provided by said input key switch means for decoding said musical information;

memory means for storing and later recalling said decoded musical information;

operating means responsive to information recalled from said memory means for generating audible sounds in response thereto; and alarm means for producing an alarm signal in response to the generation of desired horological information;

said means for generating audible sounds being responsive to the alarm signal produced by said alarm means.

34. The calculator and timepiece of claim 33 further comprising:

an additional input key switch means; and means for changing the audible sounds generated by said means for generating audible sounds in response to actuation of said additional input key switch means.

* * * * *